US006032397A

United States Patent [19]

Iannetta

[11] Patent Number: 6,032,397

[45] Date of Patent: Mar. 7, 2000

[54] COMB ASSEMBLY FOR A SHOULDER FIREARM

[76] Inventor: Luigi Iannetta, 6220 Disputed Rd., LaSalle, Ontario, Canada, N9H 1X7

[21] Appl. No.: 09/078,684

[22] Filed: May 14, 1998

[30] Foreign Application Priority Data

May 27, 1997 [CA] Canada ..... 2206237

[51] Int. Cl.[7] ..... F41C 23/00

[52] U.S. Cl. ..... 42/73; 42/74

[58] Field of Search ..... 42/71.01, 73, 74; 89/1.58

[56] References Cited

U.S. PATENT DOCUMENTS

| | | | |
|---|---|---|---|
| 2,754,608 | 7/1956 | Stieffel, Jr. | 42/74 |
| 3,233,354 | 2/1966 | Ahearn | 42/74 |
| 4,055,016 | 10/1977 | Katsenes | 42/71.01 |
| 4,663,877 | 5/1987 | Bragg | 42/74 |
| 4,896,446 | 1/1990 | Gregory | 42/73 |
| 4,910,904 | 3/1990 | Rose | 42/74 |
| 5,001,855 | 3/1991 | Griggs | 42/74 |
| 5,031,348 | 7/1991 | Carey | 42/74 |
| 5,075,995 | 12/1991 | Kennel | 42/73 |
| 5,235,764 | 8/1993 | Perazzi | 42/73 |
| 5,392,553 | 2/1995 | Carey | 42/73 |
| 5,519,957 | 5/1996 | Iannetta | 42/74 |
| 5,752,339 | 5/1998 | Bentley et al. | 42/74 |

*Primary Examiner*—Charles T. Jordan
*Assistant Examiner*—Jeffrey Howell
*Attorney, Agent, or Firm*—Staas & Halsey LLP

[57] ABSTRACT

A comb assembly is provided for a shoulder firearm which is designed and adapted to reduce rearwards and upwards recoil of the firearm towards the shooter's cheek at the time of firing. The assembly comprises a housing adapted for mounting on a firearm stock; a movable body portion mountable within the stock and adapted to move forwards and downwards in response to the recoil forces thereby moving the attached cheek piece down and away from the shooter's cheek at the time of the initial firing forces. The housing and movable portion may be combined into a single unit or device suitable for mounting on any standard shoulder firearm such as a rifle or shotgun.

19 Claims, 3 Drawing Sheets

COMB ASSEMBLY FOR A SHOULDER FIREARM

FIELD OF THE INVENTION

The present invention relates in general to a comb assembly for shoulder firearm. More particularly, the present invention relates to a comb mechanism which reduces the recoil forces against the cheek of a shooter during discharge of a shoulder firearm.

BACKGROUND OF THE INVENTION

During discharge of shoulder firearms such as rifles and shotguns recoil forces are generated which force the gun upwards and backwards against the body of the shooter. During use a firearm is typically held with the butt up against the shooter's shoulder with his or her cheek resting on a cheek piece. This common shooting stance facilitates the shooter's sightline while at the same time stabilizing the gun to reduce the effect of the recoil forces on the shooter's aim during discharge.

In the absence of a mechanism to reduce the impact, the strength of the recoil forces of the firearm during discharge are enough to cause bruising and injury to the shooter's shoulder and/or cheek after repeated use.

Prior art recoil mechanisms have been devised to reduce the recoil force felt by the shoulder of the trap shooter as well as to alleviate the problem caused by motion of the gun against the cheek of the trap shooter. For example, in U.S. Pat. No. 5,031,348, granted Jul. 16, 1991 to Donald C. Carey, a gun stock assembly with co-ordinated comb and recoil is disclosed. The Carey patent discloses a comb piece co-ordinated with the shoulder piece and associated recoil assembly. The comb piece and shoulder piece remain stationary relative to each other during shooting while the recoil assembly absorbs the recoil. The comb piece provides a stationary cheek rest which is said to eliminate the cheek-chaffing action usually associated with the use of shoulder firearms.

A similar device is disclosed in U.S. Pat. No. 4,896,446 granted Jan. 30, 1990, naming Glenn D. Gregory as inventor. The Gregory patent discloses an adjustable comb and butt plate assembly for shoulder firearms having a stock and a recoil reducing or absorbing means at the butt end of the stock. A butt plate is slidably mounted at the rear of the stock. A comb is slidably mounted on the stock. The comb and butt plate remain stationary relative to the shooter's head and body when the firearm is fired.

In addition, the Gregory and Carey patents disclose a butt plate or shoulder piece which is adjustable relative to the stock of the gun, as is the comb. Such adjustments may be made by moving the comb or butt plate on pins which extend outward from the stock of the gun.

The devices disclosed in the Carey and Gregory patents seek to avoid having a recoil force transmitted to the cheek of the trap shooter when the gun is fired by permitting the comb of the gun to slide relative to the stock of the gun. This does not prevent a force in an upward direction on the recoil of the gun causing the comb of the gun to hit the cheek of the shooter. In guns with a fixed comb, the transmission of such a force can cause bruising to the cheek of the shooter, especially upon repeated firings of the gun such as are necessary in trap shooting competitions and the like.

Another device is disclosed in U.S. Pat. No. 5,519,957 granted May 28, 1996 in the name of lannetta. In this device an assembly is provided for a firearm providing a comb and recoil mechanism for reducing the upwards and lateral forces of the firearm during discharge. The recoil mechanism is located in the interior of the stock. The comb comprises a cheek piece and a mounting piece. The mounting piece and the cheek piece are adapted to releasably engage a vertical plate at selectable points on the plate.

Many of the prior art mechanisms are complex and therefore costly to manufacture and install.

There is an ongoing need for an adjustable cheek piece or comb which substantially reduces the recoil forces against the user's cheek during discharge yet is simple and economical to manufacture and install. The present invention addresses this need by providing a comb assembly which may be mounted on most shoulder firearms to reduce the recoil impact against the shooter's cheek.

SUMMARY OF THE INVENTION

Accordingly, the present invention provides an improved comb assembly for mounting on a shoulder firearm such as a shotgun or rifle. The device of the present invention can be mounted on an existing shoulder firearm with surprisingly minimal retrofit or mounted as part of a new firearm. According to one aspect of the present invention, the comb assembly is a self-contained unit, inexpensive to manufacture and readily mountable on shoulder firearms or rifles. It would commonly be used on those of 2¾ regular calibre but may be used on 2¾ magnum or 3 magnum calibre firearms.

According to another aspect of the present invention, a comb assembly for a shoulder firearm is provided for reducing recoil against a shooter's cheek. In a preferred embodiment of the invention, the assembly comprises a moveable body portion slidably mounted within a housing suitable for installing as a distinct unit in the stock of a shoulder firearm.

According to another preferred embodiment of the present invention, the movable body portion is slidably mounted on two or more slide pins which are adapted to be releasably secured in the housing such that the slide pins can quickly move during firing from a first at rest position to a second extended, in use position and then return to the first at rest position.

According to another aspect of the present invention, the housing is adapted to absorb vibrations of the recoil effect.

According to another aspect of the present invention at the time of firing, the forward movement of the cheek piece of the gun, mounted on the comb assembly of the present invention, is accompanied by a downward movement thereby momentarily releasing the cheek piece down and away from the shooter's cheek at the time of firing the firearm.

According to another aspect of the present invention, rubberized bumpers are provided at each end of the movable body lo minimize the impact of the body against the housing to reduce vibration and increase the life span of the assembly.

According to an aspect of the present invention, a comb assembly for mounting on a shoulder firearm for reducing recoil of a firearm cheek piece against a shooter's cheek and face, when the firearm is fired, is provided. The assembly comprises:

a) a housing adapted to be mounted on a firearm stock, b) the housing having at least two sides which extend lengthwise in the firearm stock, c) the at least two sides having at least two downwardly and forwardly sloping paired sets of openings adapted to receive two or more slide means, d) a movable body mounted within the housing, e) slide means mountable on the movable body, the slide means being adapted to fit within said paired openings, f) means for releasably securing the slide means at the top of one or more of the downwardly and forwardly sloping paired openings such that when the firearm is not being fired the slide means do not slide downwardly and forwardly in the sloping paired openings, g) means for biasing the movable body portion towards a first at rest position when the firearm is not being fired such that the slide means mounted on the movable body are positioned at the top of said sloping paired openings, and h) means for attaching a cheek piece to the movable body, wherein, at the time of firing, the slide means mounted on the movable body move from the first at rest position to a second extended position by moving forwards and downwards along the sloping paired openings in response to the recoil forces, thereby causing the cheek piece to move away from the shooter's cheek during firing and then after firing returning by said biasing means to the first at rest position.

According to another aspect of the present invention, the comb assembly is provided as a single unit mountable on the stock of a shoulder firearm.

A distinct advantage of the present invention is that it can be combined into a single unit or device that can easily be mounted into the stock of any standard shoulder firearm such as a shotgun or rifle. In a particularly preferred embodiment, only four screws are required to mount the housing onto the stock, once the stock has been cul away to receive the housing. Once mounted on the firearm, any number of means may be provided for attaching a cheek piece to the movable bodly.

Other and further advantages and aspects of the present invention will become more apparent to those skilled in the art in view of the following detailed description and accompanying drawings.

BRIEF DESCRIPTION OF THE DRAWINGS

Preferred embodiments of the invention are shown in the drawings, wherein.

DETAILED DESCRIPTION OF THE PREFERRED EMBODIMENTS

The present invention will be described in detail with reference to the accompanying drawings, in which like numerals denote like parts in several views. The drawings illustrate the best mode of the invention as presently contemplated, but it is recognized that persons skilled in the art will appreciate that other modifications, variations and equivalents are possible and included within the scope of the invention.

For the purposes of the present description, the term "rearward" means in a direction towards the butt of the firearm and the term "forward" means in a direction towards the barrel end ol the firearm.

Figure 1:
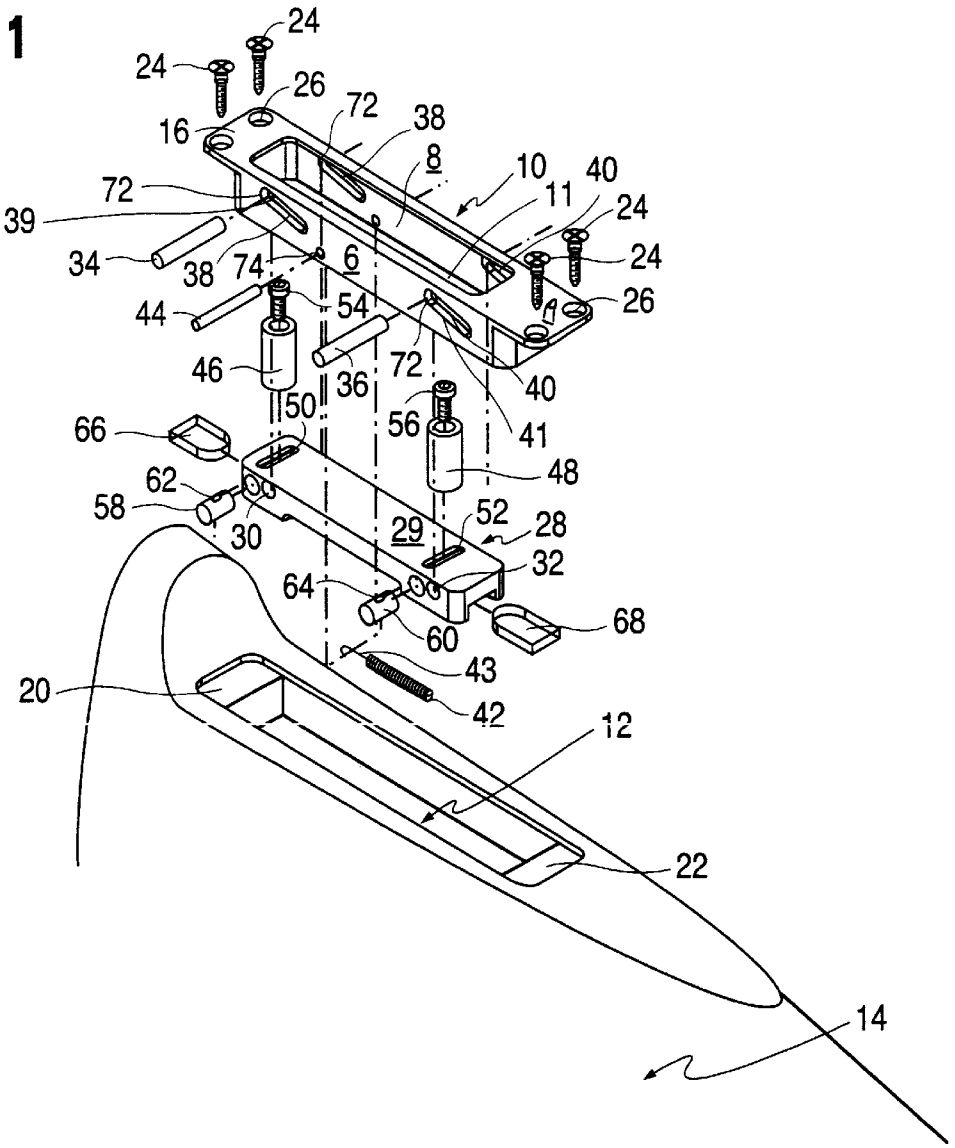
FIG. 1 is a perspective, exploded view of one embodiment of the present invention.

Turning to the drawings, FIG. 1 is an exploded view of the preferred embodiment of the comb assembly of the present invention.

Figure 2:
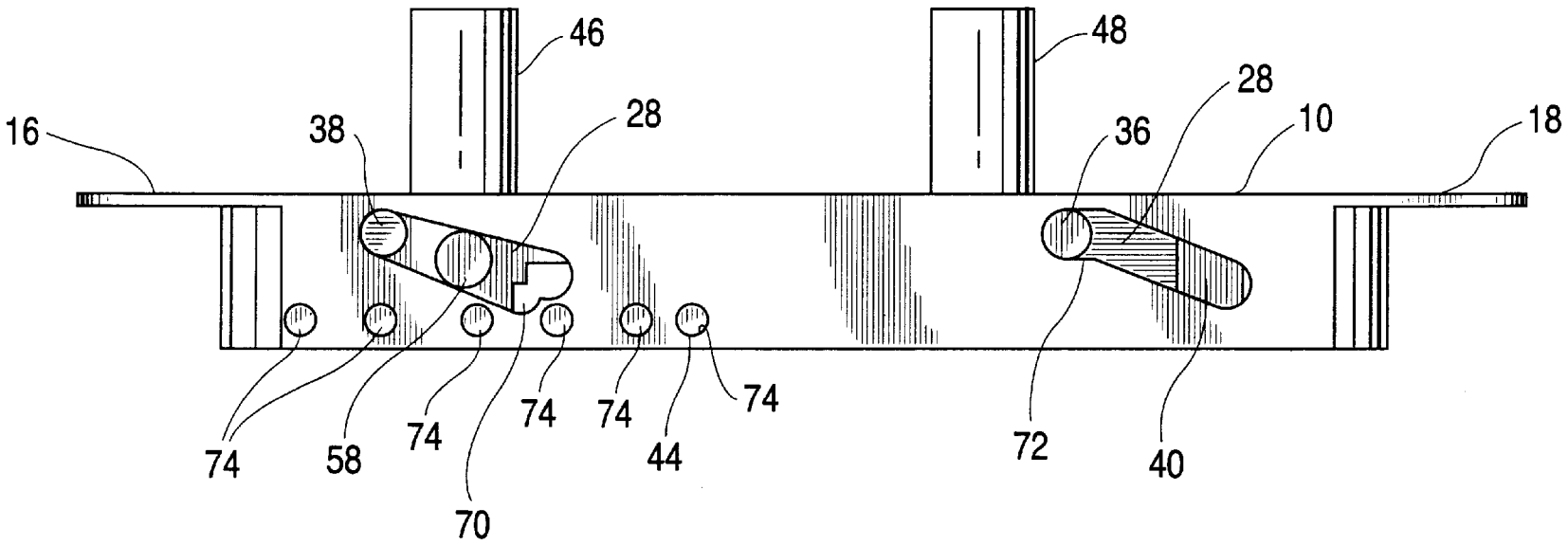
FIG. 2 is a side elevation view of another embodiment of the present invention.
Figure 3:
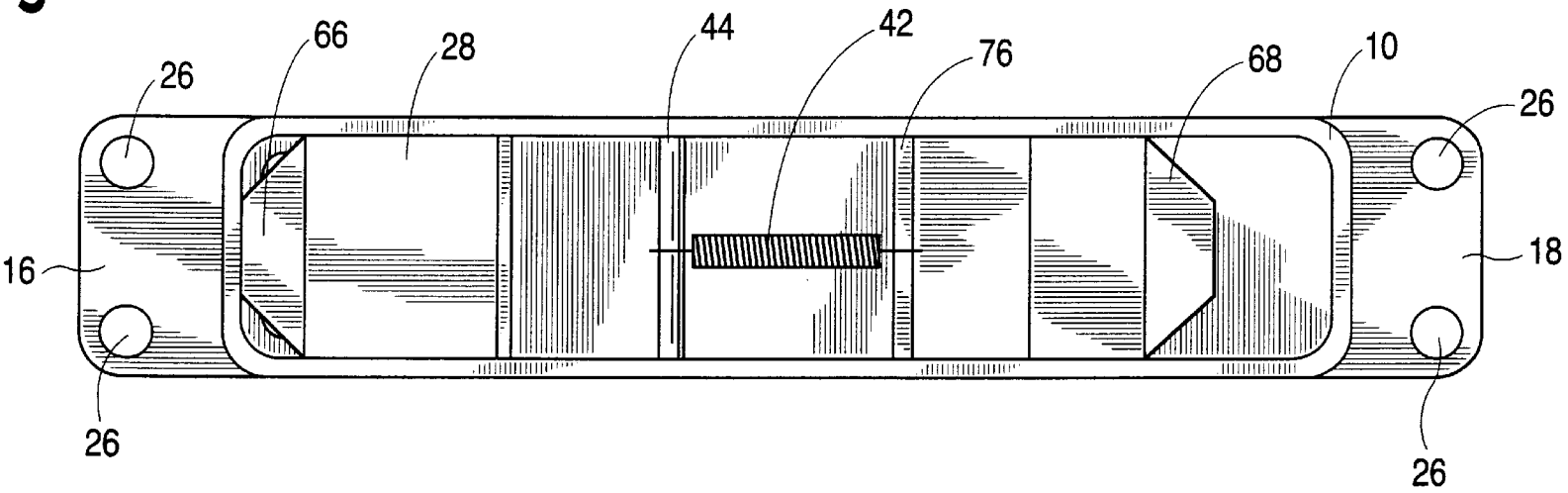
FIG. 3 is a bottom plan view of an embodiment of the present invention.

FIG. 2 is a side elevation view of another embodiment of the present invention and FIG. 3 is a bottom plan view of an embodiment of the invention.

The comb assembly housing 10 of the present invention is designed to neatly fit into a cutaway 12 in the top of a gun stock 14 and the housing 10 is adapted to be mounted on the stock 14 of a shoulder firearm. A number of mounting means may be contemplated to secure the housing 10 to the stock 14. In a preferred embodiment, the housing has two extended lips 16 and 18 which rest on ledges 20 and 22 respectively in cutaway portion 12 of the gun stock 14. Lips 16 and 18 are secured by screws 24 through openings 26. The housing 10 is not installed in the cutaway 12 until the other parts of the invention have been mounted within the housing as detailed in the exploded view in FIG. 1.

In the preferred embodiment illustrated in the drawings, a movable body portion 28 is mountable within the housing 10. The housing 10 has two sides 6 and 8 which run lengthwise and generally parallel to the sides of the gun. The sides 6 and 8 of housing 10 having opening 38 and 40 respectively on either side. The openings on each side are aligned across from each other. The movable body 28 has means for receiving slide pins which are mounted onto the movable body. In the illustrated embodiments, openings 30 and 32 receive slide pins 34 and 36 respectively. When movable portion 28 is positioned within housing 10, the openings 30, 32 align with the rearward end of corresponding pairs of elongate openings 38 and 40 respectively in housing 10.

When openings 30, 32 and 38, 40 are respectively aligned, slide pins 34 and 36 can be inserted through the aligned openings. The slide pins 34 and 36 are longer than the width of the movable body portion 28 such that the ends of the pins extend through openings 30 or 32 into paired openings 38 or 40 respectively.

Once the movable body portion 28 is positioned in the housing 10, and the slide pins 34 and 36 are positioned, the movable body portion 28 is biased against the rearward end of housing 10 by a suitable biasing means. In the preferred embodiment illustrated in the drawings, a spring 42 is used to bias the movable body portion 28 to the "at rest" position.

In the at rest position the slide means, for example slide pins 34 and 36, are releasably secured at the top of the downwardly and forwardly sloping openings 38 and 40 in housing 10. A simple latch mechanism, an extended ledge, a downward portion or other means known to a person skilled in the art could be used to prevent the slide pins from sliding down the sloped openings before the firearm is fired. In the illustrated embodiment of FIG. 1, a ledge 72 is present at the top of openings 38 and 40.

When the gun is not fired, the at rest position, the movable body is biased towards the butt of the firearm by a spring 42 or other suitable biasing means and the slide pins 34 and 36 rest on ledge 72 against a small clip 39 all of which prevent downward and forward movement of the movable body (and hence the cheek piece) before firing.

When the firearm is fired, the recoil force causes the movable body portion 28 to move forward and when it does so, the slide pins 34 and 36 move off of the ledge and downward and forward along the paired openings 38 and 40. The cheek piece (not shown) is mounted on the movable body portion 28 and moves at the same time down and away from the shooter's cheek.

In the preferred embodiment of the present invention, a spring 42 is attached to the bottom of the movable body portion by hooking one end of spring 42 over the end of a defined ridge portion 76 (FIG. 3) into an opening made in the ridge 76 for securing the spring 42. The ridge 76 is located forward of the mid-point on the bottom of the movable body portion 28.

The other end of spring 42, in the preferred embodiment, is attached to a spring retaining rod 44 on housing 10. The spring retaining rod 44 of the present invention is located on the bottom of the housing 10 rearward of the mid-point along the length of the housing. By positioning the spring in this orientation the movable body portion 28 is biased towards the butt end of the firearm in the first "at rest" position.

When biased in the first at rest position, the slide rods are releasably secured in the uppermost and rearmost aspect of the paired elongate openings 38 and 40. This aspect of the openings 38 and 40 is adapted in its shape to receive the slide rods 34 and 36 such that the rods do not slip out of position under direct vertical pressure. The slide rods 34 and 36 only move out of position and travel along the forward and downward sloping elongate openings 38 and 40 when a horizontal force is applied.

In accordance with an aspect of the present invention, the comb assembly further comprises means for attaching a cheek piece. In the preferred embodiment of the present invention illustrated in the drawings, the means for attaching a cheek piece comprises two adjustable mounting devices 46 and 48. A cheek piece is readily securable over the two mounting devices as would be known by a person skilled in the art to do.

When the movable body portion 28 is enclosed in the housing 10, the top surface 29 of the movable body portion 28 is substantially flush with the top surface 19 of housing 10. The adjustable mounting means 46 and 48 extend through the large rectangular opening 11 on housing 10 and are available for attachment of a cheek piece.

The cheek piece mounting devices 46 and 48 may be adjustable. In accordance with one embodiment, the mounting devices are releasably secured by way of a nut 58 or 60 and screw 54 or 56 and can be adjusted along lateral adjustment openings 50 and 52. In the preferred embodiment illustrated in the drawings, the mounting devices 46 and 48 comprise short threaded cylinders with long screws 54 and 56 respectively positioned in the centre of the cylinders. A suitable screw size would be 8–32 S.H.C.S. The long screws 54 and 56 extend down and through the bottom of the threaded cylinders to be secured by nuts 58 and 60 below the top surface of the movable body portion 28 via horizontal slots 50 and 52 which serve as lateral adjustment openings. Therefore, nuts 58 and 60 for receiving the adjustable mount screws 54 and 56 are contained within movable body portion 28. Nuts 58 and 60 receive screws 54 and 56 by way of threaded openings 62 and 64 which are aligned with horizontal slots 50 and 52 respectively.

When screws 54 and 56 are tightened in nuts 58 and 60 respectively, the adjustable mounting cylinders 46 and 48 are tightly secured to the movable body portion 28.

Lateral adjustment of the cheek piece can easily be made by unscrewing the adjustable mounting cylinders 46 and 48 until they are sufficiently loosened to permit lateral movement along horizontal slots 50 and 52. Once loosened, the mount with its attached screw and nut is easily moved to a new lateral position and can be tightened again in its new position by simply using a screwdriver.

In another embodiment of the present invention, bumper guards 66 and 68 may be added to the ends of the movable body portion 28 to absorb vibration and to increase the life of the comb assembly. Bumper guards 66 and 68 also reduce, to a certain extent, noise of the metal against metal as the comb assembly is extended in response to recoil forces during firing. These guards can be made of any suitable material to absorb noise and vibration such as rubber.

One skilled in the art will recognize and know that the movement of the movable body portion, and hence the cheek piece mounted thereon, needs only to be small and quick. This occurs in response to the recoil forces when the shoulder firearm is fired forcing the firearm in a rearward direction causing the movable body portion to move from its first at rest position to a second extended position and back to the at rest position as the initial recoil forces subside.

When the shoulder firearm is not being fired, or otherwise manipulated, the comb assembly and hence its attached cheek piece is maintained in a fixed position. The exact position of the cheek piece can be adjusted and re-secured using adjustable mount cylinders 46 and 48 as described. The movable body portion 28 contained within the housing 10 is held in a fixed position by the biasing force of spring 42 and the releasable locking means, established in this preferred emnbodiment, of shaping the upper, rearmost aspects of the paired elongate openings 38 and 40 to provide lips 39 and 41 which prevents the slide pins from slipping down the elongate openings 38 and 40 until a sufficient horizontal force is applied.

When the firearm is to be fired, the butt (which may have a shoulder pad) is placed against the shoulder of the shooter and the shooter's cheek is placed on the cheek piece which is mounted on the comb assembly of the present invention. As described, the comb assembly of the present invention is designed to ensure that it does not move before the shooter fires. This provides the stability necessary for accurate aiming of the firearm.

When the firearm is fired, a recoil force causes the stock 14 to move rearwardly and upwardly. This recoil force overcomes the biasing force of spring 42 and the releasable locking means in tie elongated openings 38 and 40 releases the slide pins 34 and 36 thereby rendering them free to move forwardly and downwardly along openings 38 and 40. Spring 42 absorbs the recoiling force extending the movable body portion, and hence the attached cheek piece, forward and downward to its extended second position when the forward bumper guard 68 comes to rest against the inside front end of housing 10.

In the illustrated embodiments the releasable locking means is a ledge portion 72 which is present on at least one of the downwardly and forwardly sloping openings in the side of the housing 10.

In the extended second position which occurs briefly during the recoil when firing, the movable body portion 28 is biased by extended spring 42 towards the barrel of the gun in a forward position.

One advantage of using a spring as a biasing means is that it is inexpensive and easily replaceable. As seen in FIG. 3, the spring 42 is mounted on the bottom of the housing and movable body 28 where it can easily be replaced from time to time as needed. For example, if the spring begins to stretch and lose its resiliency, it can be readily replaced by a new one. If a stronger spring is required for a higher caliber firearm, then this is easily replaced. The housing 10/movable body 28 combination can be readily unscrewed from the stock 14 as a unit and turned over to replace the spring. The unit can then be quickly installed again in the firearm.

Depending on the size of the firearm the spring 42 can be lengthened to increase the tension in it by moving the spring retaining rod 44 to a different position. As seen in FIG. 2, the housing 10 may have additional mounting holes 74 in the housing to allow for different pin placements. The mounting holes would be present on both sides of the housing and the pin secured therebetween at the desired distance. By changing the position of the retaining pin to increase the tension on the spring, one could accommodate shoulder firearms of larger calibres. For example, 2¾ regular, 2¾ magnum or 3 magnum could be accommodated. By increasing the tension in the spring the tension on the cheek piece is increased. A larger spring may also be used. Suitable spring sizes and tensions would be known by persons skilled in the art.

Other biasing means and equivalents to the spring would also work and these would be readily apparent to a person skilled in the art.

In one preferred embodiment, one of the elongate openings is extended and enlarged to a diameter which is greater than the diameter of the slide pin 38 as illustrated in FIG. 2 at element 70. This embodiment dampens the impact during recoil by absorbing some vibrations. It allows the vibrations to be absorbed by the movement of the slide pin 38 in the wider slot portion when moving in the extended position. Therefore, the vibrations are absorbed in the gun and not by the shooter's cheek.

In another preferred embodiment the comb assembly is made from aluminum metal. Other suitable metals, including steel, may be used and would be known to a person skilled in the art.

In another embodiment of the present invention (not shown), the comb assembly is molded from plastic, thus reducing the number of parts. Bumper guards 66 and 68 may not be necessary in this embodiment.

A person skilled in the art will appreciate that this embodiment molded from plastic may include attaching the one end of spring 42 onto a projection or other connecting structure in housing 10 itself, instead of attaching this same end of spring 42 to spring retaining rod 44. This fastening arrangement for spring 42 eliminates the need for the spring retaining rod 44 and associated mounting holes 74. As in the preferred embodiment shown in the figures, the movable body portion 28 is biased towards the butt end of the firearm in the first "at rest" position.

A person skilled in the art will appreciate that the abovementioned embodiment molded from plastic permits forming mounting cylinders 46 and 48 integrally with the movable body portion 28 and in a fixed position. Consequently, the fixed positioning of mounting cylinders 46 and 48 eliminates the need for nuts 58 and 60, threaded openings 62 and 64 and horizontal slots 50 and 52. The fixed positioning of mounting cylinders 46 and 48 results in a fixed cheek piece relative to the movable body portion 28.

Other advantages of making the comb assembly from plastic will be apparent to those skilled in the art.

Although various preferred embodiments of the present invention have been described herein in detail, it will be appreciated by those skilled in the art, that variations may be made thereto without departing from the spirit of the invention or the scope of the appended claims.

What is claimed is:

1. A comb assembly for mounting on a shoulder firearm for reducing recoil of a firearm cheek piece against a shooter's cheek and face, when the firearm is fired, the assembly comprising:

a) a housing adapted to be mounted on a firearm stock, b) the housing having at least two sides which extend lengthwise in the firearm stock, c) the at least two sides having at least two downwardly and forwardly sloping paired sets of openings adapted to receive two or more slide means, d) a movable body mounted within the housing, e) slide means mountable on the movable body, the slide means being adapted to fit within said paired openings, f) means for releasably securing the slide means at the top of one or more of the downwardly and forwardly sloping paired openings such that when the firearm is not being fired the slide means do not slide downwardly and forwardly in the sloping paired openings, g) means for biasing the movable body portion towards a first at rest position when the firearm is not being fired such that the slide means mounted on the movable body are positioned at the top of said sloping paired openings, and h) means for attaching a cheek piece to the movable body, wherein, at the time of firing, the slide mean, mounted on the movable body move from the first at rest position to a second extended position by moving forwards and downwards along the sloping paired openings in response to the recoil forces, thereby causing the cheek piece to move away from the shooter's cheek during firing and then after firing returning by said biasing means to the first at rest position.

2. The comb assembly according to claim 1 wherein the slide means are slide pins.

3. The comb assembly according to claim 2 wherein the slide pins extend through the movable body and rest on the edges of the sloping paired openings.

4. The comb assembly according to claim 1 wherein the movable body portion is biased towards the rest position by a suitable biasing means.

5. The comb assembly according to claim 3 wherein the movable body portion is biased towards the rest position by a spring means.

6. The comb assembly according to claim 5 wherein the spring means is connected at one end to a spring retainer pin located rearward of the midpoint on the housing and the other end of the spring is connected forward of the midline on the movable body portion.

7. The comb assembly according to claim 1 wherein the means for attaching the cheek piece is adjustable.

8. The comb assembly according to claim 7 wherein the adjustable means for attaching the cheek piece comprises two adjustable mounts extending above the upper surface of the movable body.

9. The comb assembly according to claim 8 wherein the adjustable mounts are movable from side to side along one or more horizontal slots and securable by a nut and screw mechanism.

10. The comb assembly according to claim 1 wherein the means for releasably securing the slide means is a horizontal ledge on the top of and continuous with one or more of the downwardly and forwardly sloping openings, wherein one or more slide means rests on the horizontal ledge in the at rest position and, during firing, is free to move forwardly and downwardly in response to the recoil forces.

11. A combination housing and comb assembly unit mountable as a single unit in a stock of a firearm, the combination comprising:

a) a housing adapted to be mounted on a firearm stock, b) the housing having at least two sides which extend lengthwise in the firearm stock, c) the at least two sides having at least two downwardly and forwardly sloping paired sets of openings adapted to receive two or more slide means, d) a movable body mounted within the housing, e) slide means mountable on the movable body, the slide means being adapted to fit within said paired openings, f) means for releasably securing the slide means at the top of one or more of the downwardly and forwardly sloping paired openings such that when the firearm is not being fired the slide means do not slide downwardly and forwardly in the sloping paired openings, g) means for biasing the movable body portion towards a first at rest position when the firearm is not being fired such that the slide means mounted on the movable body are positioned at the top of said sloping paired openings, and h) means for attaching a cheek piece to the movable body, wherein, at the time of firing, the slide means mounted on the movable body move from the first at rest position to a second extended position by moving forwards and downwards along the sloping paired openings in response to the recoil forces, thereby causing the cheek piece to move away from the shooter's cheek during firing and then after firing returning by said biasing means to the first at rest position.

12. The combination according to claim 11 wherein the slide means are slide pins.

13. The combination according to claim 12 wherein the slide pins extend through the movable body and rest on the edges of the sloping paired openings.

14. The combination according to claim 11 wherein the movable body portion is biased towards the rest position by a suitable biasing means.

15. The combination according to claim 13 wherein the movable body portion is biased towards the rest position by a spring means.

16. The combination according to claim 15 wherein the spring means is connected at one end to a spring retainer pin located rearward of the midpoint on the housing and the other end of the spring is connected forward of the midline on the movable body portion.

17. The combination according to claim 11 wherein the means for attaching the cheek piece is adjustable.

18. The combination according to claim 17 wherein the adjustable means for attaching the cheek piece comprises two adjustable mounts extending above the upper surface of the movable body.

19. The comb assembly according to claim 11 wherein the means for releasably securing the slide means is a horizontal ledge on the top of and continuous with one or more of the downwardly and forwardly sloping openings, wherein one or more slide means rests on the horizontal ledge in the at rest position and, during firing, is free to move forwardly and downwardly in response to the recoil forces.

* * * * *